US005919751A

United States Patent [19]

Bird et al.

[11] Patent Number: 5,919,751

[45] Date of Patent: Jul. 6, 1999

[54] FABRIC CONDITIONING COMPOSITION

[75] Inventors: Nigel Peter Bird, Bebington; Timothy David Finch, Bromborough; Stuart Bernard Fraser; Christopher Maddison, both of South Wirral; Christopher Whaley, Higher Bebington, all of United Kingdom

[73] Assignee: Lever Brothers Company, New York, N.Y.

[21] Appl. No.: 08/859,965

[22] Filed: May 21, 1997

[30] Foreign Application Priority Data

May 23, 1996 [GB] United Kingdom ..... 9610865
Jul. 12, 1996 [GB] United Kingdom ..... 9614661

[51] Int. Cl.[6] ..... D06M 13/00; D06M 13/02

[52] U.S. Cl. ..... 510/522; 510/521; 510/527

[58] Field of Search ..... 510/522, 527, 510/521

[56] References Cited

U.S. PATENT DOCUMENTS

| | | | |
|---|---|---|---|
| 4,096,072 | 6/1978 | Brock et al. | 427/375 |
| 4,237,016 | 12/1980 | Rudkin et al. | 510/521 |
| 4,308,151 | 12/1981 | Cambre | 510/515 |
| 4,417,895 | 11/1983 | Hennemann et al. | 8/137 |
| 4,555,349 | 11/1985 | Butterworth et al. | 510/526 |
| 4,788,054 | 11/1988 | Bernhardt et al. | 424/59 |
| 4,792,409 | 12/1988 | Sherman et al. | 510/527 |
| 4,923,622 | 5/1990 | Sherman et al. | 510/525 |
| 5,474,691 | 12/1995 | Severns | 510/516 |
| 5,498,350 | 3/1996 | Sakata et al. | 510/526 |
| 5,500,138 | 3/1996 | Bacon et al. | 510/102 |
| 5,540,853 | 7/1996 | Trinh et al. | 510/101 |

FOREIGN PATENT DOCUMENTS

| | | |
|---|---|---|
| 0193932 | 9/1986 | European Pat. Off. . |
| 1601359 | 10/1981 | United Kingdom . |
| 86/02392 | 4/1986 | WIPO . |
| 94/19439 | 9/1994 | WIPO . |

OTHER PUBLICATIONS

Search Report under Section 17, Application No. GB 9614661.8 dated Oct. 9, 1996.

Search Report under Section 17, Application No. GB 9610865.9 dated Aug. 14, 1996.

International Search Report No. PCT/EP 97/02160 dated Sep. 2, 1997.

*Primary Examiner*—Anthony Green
*Attorney, Agent, or Firm*—Neil Y. Gilbert

[57] ABSTRACT

A rinse conditioner giving excellent deposition of a fabric treatment agent onto fabric. The rinse conditioner comprising a fabric softening compound, a water insoluble oil and from 0.1% to 10% by weight of the total composition of a Fabric Treatment Agent, wherein the Fabric Treatment Agent has a c.logP of 3.0 or more.

8 Claims, No Drawings

FABRIC CONDITIONING COMPOSITION

TECHNICAL FIELD

The present invention relates to fabric conditioning compositions. In particular the present invention relates to fabric conditioning compositions that give an additional benefit, other than merely softening or perfuming the fabric.

BACKGROUND OF THE INVENTION

Fabric conditioners are commonly used to deposit a softening compound and a perfume onto a fabric. Their use to deposit other fabric treatment aids has been commercially limited mainly due to difficulties in depositing the fabric treatment aid onto a fabric.

It is known in the textile industry (WPI ACC No 92-336162/41 and WPI 92-138679/17) to apply UV absorbers and antioxidants to synthetic fibers used in carpets and furnishing fabrics to minimise fading. However the textile compositions, UV absorbers used, and methods and levels of application are not suitable for domestic processes.

U.S. Pat. No. 4,788,054 (Bernhardt) teaches the use of N-phenylphthalisomides as ultraviolet radiation absorbers for cotton, wool, polyester and rayon. The compositions require that an aqueous sulphuric acid vehicle is required for deposition.

U.S. Pat. No. 5,474,691 Severns teaches that photofading of fabrics can be prevented by treating the fabric using a tumble dryer article comprising a conditioning compound, a uv absorbers and/or an antioxidant. However this system of delivering the uv absorber/antioxidant to the laundry results in an uneven deposition of uv absorber/antioxidant. A further disadvantage with this system is that a high level of uv absorber/antioxidant has to be used.

U.S. Pat. No. 4,417,895 (Henkel) discloses antimicrobial treatment of textiles during the wash using liquid washing agents based on nonionic surfactants, quaternary ammonium compounds and azoles.

The use of ester oils as an ingredient in a fabric softening composition is disclosed in GB 1 601 359 (Procter and Gamble). The ester oil is one of a number of lubricants mentioned.

The problems associated with the prior art of poor deposition and thus use of high levels of fabric treatment agent have been solved by the present invention. The present invention also overcomes the problems of incompatibility between the softening compound and a fabric treatment agent and the problem of poor phase stability of the rinse conditioner.

DEFINITION OF THE INVENTION

Thus according to one aspect of the invention there is provided a rinse conditioner comprising a cationic fabric softening compound, a water insoluble oil and from 0.1% to 10% by weight of the total composition of a Fabric Treatment Agent, wherein the Fabric Treatment Agent has a c.logP of 3.0 or more.

The invention also provides a process for treating laundry, the process having the following steps:

i) placing the laundry in a domestic washing machine;

ii) adding the composition above to the machine and;

iii) washing or rinsing the laundry under normal domestic conditions.

The invention further provides the use of a water insoluble oil within a fabric softening composition to deposit a Fabric Treatment Agent, having a c.logP of 3.0 or more, from said composition onto a fabric.

DETAILED DESCRIPTION OF THE INVENTION

The present invention has the advantage that it delivers a Fabric Treatment Agent onto the fabric with very little Fabric Treatment Agent being wasted within the rinse liquor.

Compositions of the invention have the further advantage that the Fabric Treatment Aid is not incompatible with the fabric softening phase of the formulation and thus there is no phase instability.

The Fabric Treatment Agent

The Fabric Treatment Agent is any agent used to give an effect other than the commonplace effects of cleaning, softening or perfuming the fabrics.

A parameter which can be used to define compounds of suitable hydrophobicity is the calculated octanol water partition coefficient frequently abbreviated to c.logp These are calculated according to the methods quoted in "The hydrophobic Fragmental Constant" R. F. Rekker, Elsevier, Oxford or Chem.Rev, Vol 71, No 5, 1971, C. Hansch and A. I. Leo, or by using Daylight Chemical Information Systems. Inc. C.logP programs. Using this parameter it is possible to define a minimum level of hydrophobicity which corresponds with efficient deposition. The Fabric Treatment Agent should have a c.logP value equal to or greater than 3.0, more preferably equal to or greater than 3.5, most preferably equal to or greater than 4.5.

It is particularly preferred if the Fabric Treatment Agent has a c.log P of equal to or less than 6.5.

Typical examples of Fabric Treatment Agents are insect control agents, hygiene agents or compounds used to prevent the fading of coloured fabrics. The invention also encompasses mixtures of these agents. This invention is particularly advantageous in delivering compounds used to prevent the fading of coloured fabrics, in particular mixtures of antioxidants and UV absorbers.

The term Fabric Treatment Agent in the context of the present application specifically excludes perfumes, strongly ionising species such as cationic quaternary ammonium compounds, sulphonates, phosphates and compounds having a molecular weight greater than 1000 i.e. polymeric compounds.

The Fabric Treatment Agent should be hydrophobic as these materials deposit better onto the fabric in the presence of the delivery system of the present invention.

The Fabric Treatment Agent is present in the invention at a level from 0.1 to 10% by weight of the total composition, preferably from 0.25 to 5% by weight of the total composition. The level of Fabric Treatment Agent is dependent on the Agent that is to be delivered.

As above the ratio of Fabric Treatment Agent to water insoluble oil depends on the Fabric Treatment Agent that is to be delivered. Generally, the ratio of Fabric Treatment Agent to water insoluble oil is preferably 1:200 to 1:2, more preferably 1:100 to 1:1, more preferably 1,1:50 to 1:10, especially 1:40 to 1:20.

The ratio of Fabric Treatment Agent to cationic softening compound is preferably from 1:500 to 4:1, more preferably from 1:250 to 1:1, most preferably from 1:50 to 1:2.

Fabric Anti-Fading Agents

The fabric anti-fading agent comprises a ultra-violet absorbing compound or an antioxidant/singlet oxygen quencher or most preferably mixtures of the two.

The anti-fading agent is preferably non fabric staining and light stable. It may be a single UV absorbing compound or a mixture of compounds which absorb solar radiation light from 280 nm through to 400 nm. More preferable are those UV absorber compounds which have high extinction coefficients across this part of the spectrum.

Examples of typical UV absorbers which are not meant to be exclusive are:

2-ethyl hexyl-4-methoxy cinnamate,
2-ethoxyethyl-4-methoxy cinnamate,
normal or iso propyl-4-methoxy cinnamate,
iso amyl-4-methoxy cinnamate,
cyclohexyl-4-methoxy cinnamate,
octyl cinnamate,
2 ethyl hexyl, 3,3,5 trimethyl, cyclohexyl, amyl, menthyl, homomenthyl, phenyl, benzyl and decyl salicylate esters.

Benzophenones, especially:

2-hydroxy-4-alkoxybenzophenone;
2,2'-hydroxy-4,4'-methoxybenzophenone;
2-hydroxy-4-(2ethylhexyloxy)benzophenone;
2-hydroxy-4-methoxy-4'methyl-benzophenone;
2-hydroxy-4n-octoxybenzophenone;
2-hydroxy-4n-decyloxybenzophenone;
4-phenylbenzophenone;
2-ethylhexyl-4'phenyl-benzophenone-2 carboxylate;

Acrylates especially:

2-ethylhexyl-2cyano-3,3'-diphenylacrylate;
ethyl2-cyano-3,3,1-diphenylacrylate;
3-imidazol-4yl acrylic acid and ethyl ester;
2-cyano-3-(4methoxyphenyl)acrylate and hexyl ester;
1-(4isopropylphenyl)-3-phenylpropane-1.3-dione;
1-(4-t-butylphenyl)-3-(4-methoxyphenyl)propan-1.3-dione;
1,3-bis(4-methoxyphenyl)propan-1.3-dione;
3-(4methylbenzylidene)bornan-2-one;
N-(4-ethoxycarbonylphenyl)-N'-methyl-N'-phenylformamidine;
N-(4-ethoxycarbonylphenyl)-N'-ethyl-N'-phenylformamidine;
2-(6-chloro-2H-benzotriazol-2-yl)-4-methyl-6-t-butylphenol;
2-(6-chloro-2H-benzotriazol-2-yl)-4-6-di-t-butylphenol;
2-(6-chloro-2H-benzotriazol-2-yl)-4-6-di-t-pentylphenol;
2-ethylhexyl 4-methoxycinnamate;
2-ethylhexyl-4-dimethylaminobenzoate 4-aminobenoic acid
2-phenylbenzimidazole-5-sulphonic acid and their salts.

It is especially preferred if the UV absorber has a c.logP of 5.2 or more.

The antioxidant(s) should be non fabric staining, light stable, compounds. Antioxidant as used herein means those materials which act to prevent oxidation in products by functioning as free radical scavengers and as singlet oxygen quenchers.

Preferably the antioxidant must dissipate the energy by physical means rather than by chemical reaction. If they do react they must not discolor the fabric. Therefore a selection of suitable antioxidants must be made. Examples of antioxidants meeting these requirements can be found in Kirk-Othmer Encyclopedia of Chemical Technology, fourth edition, volume 3, pages 424–447.

Examples of typical antioxidant compounds/singlet oxygen quenchers are:

ascorbic palmitate, butylated hydroxy anisole, tertiary butyl hydroquinone, natural tocopherols and derivatives such as vitamin E acetate and Irganox antioxidants as supplied by Ciba Geigy such as Irganox 1010 (tetrakis methylene (3,5-di-tert-butyl-4hydroxycinnamate)) methane), Irganox 1035 (thiodiethylene bis (3,5-di-tert-butyl-4-hydroxyhydrocinnamate)), Irganox 1076 (octadecyl propan-(3-benzene-3',5' di tert butyl-4' hydroxy)-oate, Irganox 1425 (calcium bis (monoethyl(3,5-di-tert-butyl-4-hydroxybenzyl) phosphonate), Irganox 3052 2-propanoic acid 2-(1,1-di-tertiary butyl)-6-[3-(1,1di-tertiary butyl)-2-hydroxy-5-methylphenyl]-4-methylphenyl ester, Irganox 3114 (1,3,5-tris(3,5-di-tert-butyl-4-hydroxybenzyl)-s-triazine-2,4,6-(1H, 3H, 5H)trione Irganox 3125 3,5-di-tert-butyl-4-hydroxyhydrocinnamic triester with 1,3,5,-tris(2-hydroxyethyl)-s__-triazine-2,4,6-(1H, 3H, 5H)-trione), Irganox 1098 (N,N'-hexamethylene bis(3,5-di-tert-butyl-4-hydroxyhydrocinnamamide), and mixtures thereof.

Insect Control Agent

The term insect control agent refers to both insecticides and insect repellents either individually or as mixtures.

It is preferred in the context of the present application if the insect control agent is an insect repellant. Examples of suitable insect repellents can be found in Kirk-Othmer Encyclopedia of Chemical Technology, fourth edition, volume 13 pages 474 to 478, however the insect repellents must have the required clog p value.

It is especially preferred if the insect agent has a c.log P of 6 or more.

Preferred insect repellents include benzyl benzoate, bioallethrin and dimethrin.

Especially preferred insect control agents are based on pyrethroid insecticides, in particular 3-phenoxybenzyl-DL__cis, trans-3-(2,2-dichlorovinyl)-2,2-dimethylcyclopropanecarboxylate (permethrin).

Hygiene Agents

The term hygiene agents encompasses fungicides and antimicrobials that when applied to fabric respectively prevent or reduce the growth of fungi and bacteria.

The levels of antimicrobial and/or fungicides should be such that they prevent bacterial and fungi growth on fabrics rather than merely preventing growth within the fabric softening composition per se.

Examples of suitable fungicides are given in WO 94/10286 (Henkel), CA 943 429(Unilever) and U.S. Pat. No. 3,426,024(Henkel). As described above the hygiene agents should have a c.logP of at least 3.0, especially preferred are hygiene agents having a c.log P of 5 or more.

Preferred antimicrobials are 2-(thiocyanomethylthio) benzothiazole ((Busan 30 WB ex Buckman), butyl 4-hydroxybenzoate (Butyl Parabens ex Nipa Labs), propyl 4-hydroxybenzoate (Propyl Parabens ex Nipa Labs), Terpineol, Borneol, Fenchyl alcohol, trichlorocarbanilide.

Especially preferred are Irgasan DP300 (2,4,4'-trichloro-2hydroxydiphenylether), and the higher homologues of hyroxybenzoate esters.

The water Insoluble Oil

The water insoluble oil is preferably mobile at room temperature. The Fabric Treatment Agent is soluble in the water insoluble oil.

Preferred water insoluble oils have a c.logP value of at least 3.5, more preferably of at least 6, most preferably of at least 8, especially preferred are water insoluble oils with a c.logP value of at least 10.

The water insoluble oil is preferably a hydrocarbon oil such as mineral oil or an ester oil. If the water insoluble oil is an ester oil it is preferred if it is a fatty ester of a mono or polyhydric alcohol having from 1 to about 24 carbon atoms in the hydrocarbon chain, and mono or polycarboxylic acids having from 1 to about 24 carbon atoms in the hydrocarbon chain with the proviso that the total number of carbon atoms in the ester oil is equal to or greater than 16 and that at least one of the hydrocarbon radicals in the ester oil has 12 or more carbon atoms. Most preferably the fatty acid is a naturally occurring one, such as rape oil or coconut oil.

Other ester oils suitable for use in the present invention are the PRIOLUBES from Unichema. In particular PRIOLUBE 1407, PRIOLUBE 1447, PRIOLUBE 1415, PRIOLUBE 1446, PRIOLUBE 1427, PRIOLUBE 1445, PRIOLUBE 2045, PRIOLUBE 3988, PRIOLUBE 3987, PRIOLUBE 2091, UCN 88.212 AND ESTOL 1527 are advantageously employed. Of these PRIOLUBE 2045, which is a neopentyl glycol monomerate, is particularly useful. The fatty acid mixture for this ester is called in the oleochemical industry "monomer fatty acid" and derives from the dimerisation of rape oil (eruca low) fatty acid or oleine from tallow. In the dimerisation process, dimer, trimer acids and so called monomeric acids are formed. After the dimerisation the "monomeric" part is separated via distillation.

It is preferred if the water insoluble oil is a saturated material to avoid discolouration of the fabric or malodour development in the container or when deposited onto the fabric.

It is preferred if the water insoluble oil does not soften to any great extent.

The water insoluble oil aids the deposition of the Fabric Treatment Agent onto the fabric from the conditioning composition.

The Fabric Softening Compound

In the first instance any suitable fabric softening compound is suitable for use with the present invention, in particular nonionic softening compounds and cationic softening compounds.

It is preferred if the fabric softening compound is cationic in nature. Preferably the cationic fabric softening compound of the invention has two long chain alkyl or alkenyl chains with an average chain length greater than $C_{14}$, more preferably each chain has an average chain length greater than $C_{16}$, more preferably at least 50% of each long chain alkyl or alkenyl group has a chain length of $C_{18}$.

It is preferred if the long chain alkyl or alkenyl groups of the fabric softening compound are predominantly linear.

The cationic fabric softening compositions of the invention are compounds molecules which provide excellent softening, characterised by chain melting —Lβ to Lα—transition temperature greater than 25° C., preferably greater than 35° C., most preferably greater than 45° C. This Lβ to Lα transition can be measured by DSC as defined in "Handbook of Lipid Bilayers, D Marsh, CRC Press, Boca Raton Florida, 1990 (Pages 137 and 337).

It is preferred if the softening compound is substantially insoluble in water. Substantially insoluble fabric softening compounds in the context of this invention are defined as fabric softening compounds having a solubility less than $1\times10^{-3}$ Wt % in demineralised water at 20° C., preferably the fabric softening compounds have a solubility less than $1\times10^{-4}$, most preferably the fabric softening compounds have a solubility at 20° C. in demineralised water from $1\times10^{-8}$ to $1\times10^{-6}$.

It is especially preferred if the fabric softening compound is a water insoluble quaternary ammonium material which comprises a compound having two $C_{12-18}$ alkyl or alkenyl groups connected to the molecule via at least one an ester link. It is more preferred if the quaternary ammonium material has two ester links present. The especially preferred ester-linked quaternary ammonium material for use in the invention can be represented by the formula:

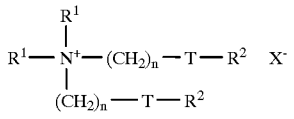

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups;

T is

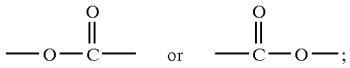

$X^-$ is any suitable anion and n is an integer from 0–5.

A second preferred type of quaternary ammonium material can be represented by the formula:

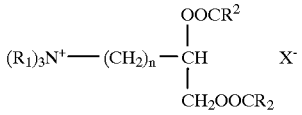

wherein $R_1$, $X^-$ n and $R_2$ are as defined above.

It is advantageous for environmental reasons if the quaternary ammonium material is biologically degradable.

Preferred materials of this class such as 1,2 bis[hardened tallowoyloxy]-3-trimethylammonium propane chloride and their method of preparation are, for example, described in U.S. Pat. No. 4,137,180 (Lever Brothers). Preferably these materials comprise small amounts of the corresponding monoester as described in U.S. Pat. No. 4,137,180 for example 1-hardened tallowoyloxy -2-hydroxy trimethylammonium propane chloride.

The fabric softening agent may also be polyol ester quats (PEQs) as described in EP 0638 639 (Akzo).

The ratio of water insoluble oil to fabric softening compound is preferably 1:10 to 10:1, more preferably 1:2 to 4:1, most preferably 1:1 to 2:1.

Composition pH

The compositions of the invention preferably have a pH of at least 1.5, and/or less than 5.

Other Ingredients

The composition can also contain fatty acids, for example $C_8$–$C_{24}$ alkyl or alkenyl monocarboxylic acids, or polymeric carboxylic acids. Preferably saturated fatty acids are used, in particular, hardened tallow $C_{16}$–$C_{18}$ fatty acids.

The level of fatty acid material is preferably more than 0.1% by weight, more preferably more than 0.2% by weight. Especially preferred are concentrates comprising from 0.5 to 20% by weight of fatty acid, more preferably 1% to 10% by weight. The weight ratio of fabric softening compound to fatty acid material is preferably from 10:1 to 1:10.

The composition can also contain one or more optional ingredients, selected from non-aqueous solvents, pH buffering agents, perfumes, perfume carriers, colorants, hydrotropes, antifoaming agents, polymeric or other thickening agents, opacifiers, and anti-corrosion agents.

The compositions of the invention may be in any product form such as solid or paste, however it is preferred if they are liquid. It is further preferred if the principal medium for the composition is water.

It is preferred if the compositions of the invention do not contain alkoxylated β-sitosterol compounds.

The invention will now be illustrated by reference to the following non-limiting Examples.

Comparative Examples are illustrated by a letter and Examples of the invention by a number:

EXAMPLES

Example 1—Insecticide

Example 1 is: Arquad 2T 5.0%, Permethrin 1.0%, Citric acid 1.0% diethyl phthalate 3.0%.

c.logp for permethrin is 6.2.

where Arquad 2T is di(tallow)dimethyl ammonium chloride ex Akzo.

Deposition of permethrin was analysed as follows: 3 Pieces of Terry cotton 19cm$^2$ were weighed and rinsed with 4 g/1 of the conditioners in a tergotometer. After hand wringing and overnight line drying the cloths were extracted with ethanol and the permethrin levels determined by GC/MS with the following results.

TABLE 1

| Amount of Peremthrin | Amount of Permethrin deposited | |
|---|---|---|
| available (mg\g) | Example 1 (mg\g) | (%) |
| 0.8 | 0.72 | 90 |

Examples A and B—Insect Repellents

Example A is: Arquad 2HT 5.0%, N,N diethyl toluamide 3.0%

Example B is: Arquad 2HT 5.0%, isopropyl myristate 3.0, N,N diethyl toluamide (insecticide)3.0%.

N,N diethyltoluamide (DEET) is an insect repellent having a clog value of 1.7 and is thus outside the scope of the invention.

Deposition of DEET was measured as follows: Three 19 cm$^2$ pieces of terry cotton were rinsed in a tergotometer with 1 liter of water containing 2 g/l of either the control or prototype formulations. After wringing out and line drying overnight the DEET was extracted and measured by GCMS.

TABLE 2

| Amount of DEET | Amount of insect repellent deposited | | | |
|---|---|---|---|---|
| available (mg\g) | Example A (mg\g) | (%) | Example B (mg\g) | (%) |
| 1.2 | 0.49 | 41 | 0.54 | 45 |

Thus compounds having c.log P below the claimed level do not deposit to any great extent from these formulations.

Example 2 and Example C—Anti-bacterial

Example C: Arquad 2HT 5.0%, DP300 0.5% or 1.0%. Example 2 is: Arquad 2HT 5.0%, iso propyl myristate 5.0% and Irgasan DP300 (antibacterial) at 0.5% or 1.0%.

Deposition of Irgasan DP300 was measured as follows: Four 10 cm$^2$ pieces of cotton sheeting were soaked in 50 mL of a solution of the above products at 2 g/L. After drying the cloths were extracted into ethanol and the DP300 measured by uv absorbance. The c.logP for Irgasan DP300 is 5.77.

TABLE 3

| Amount of | Amount Deposited | | | |
|---|---|---|---|---|
| Irgasan DP300 available | Example C (mg\g) | (%) | Example 2 (mg\g) | (%) |
| 0.33 | 0.0926 | 28 | 0.23 | 70 |
| 0.167 | 0.0586 | 35 | 0.14 | 83 |

Examples 3 and Examples D,E, and F—Sunscreen

Rinse conditioner products were prepared using a Silverson high shear mixer. Where present, ester oil and sunscreen were premixed and incorporated into hot water, without pre-heating, after addition of the molten active.

Arquad 2HT is di(hardened tallow)dimethylammonium chloride (DHTDMAC) ex Akzo. Parsol MCX is the Givaudan trade name for 2-ethylhexyl-4-methoxycinnamate and has a c.logP value of 5.2.

Priolube 2045 is neo-pentylglycol monomerate ester ex Unichema.

Wash/rinse treatments were conducted in a Tergotometer using the following conditions:

TABLE 4

| Load | 2–10 Fabric test pieces (10 cm × 10 cm) |
|---|---|
| Wash/rinse volume | 1 liter |
| Water hardness | Demineralised water |
| Temperature | 20° C. |
| Agitation | 100 rpm |
| Rinse product | 2 g/l |
| Rinse time | 5 min |

Fabric UV absorbances were measured on a Perkin Elmer Lambda 9 UV/visible reflectance spectrophotometer. Results are quoted as F(R) values (Kulbelka-Munk function values) and integrated F(R) values over the solar UV range (290–400 nm). The F(R) value is directly correlated to the level of deposition of the sunscreen (Parsol).

The formulations below are in weight % by remaining percentage being water.

The effect of product composition on the UV absorbance delivered to white fabric is shown below. As before, results are expressed both as F(R) values at the Parsol MCX λmax (310 nm) and as the integrated F(R) values across the solar UV range.

TABLE 5

| Examples | DHTDMAC/ Priolube/2045/ Parsol MCX (%) | F (R) at 310 nm | Integrated F (R) 290–400 nm |
|---|---|---|---|
| 3 | 5/5/5 | 12.4 | 520 |
| D | 5/0/5 | 3.2 | 134 |
| E | 5/5/0 | 0.1 | 4 |
| F | 5/0/0 | — | — |

We claim:

1. A rinse conditioner comprising a fabric softening compound, a water insoluble oil and from 0.1% to 10% by weight of the total composition of a Fabric Treatment Agent, wherein the Fabric Treatment Agent is not a perfume, cationic quaternary ammonium compound, sulphonate, phosphate or compound having a molecular weight greater than 1000 and the Fabric Treatment Agent has a c.logP of 3.0 or more.

2. A rinse conditioner according to claim 1 in which the Fabric Treatment Agent has a c.logP value of 4.5 or more.

3. A rinse conditioner according to claim 1 which is in liquid form.

4. A rinse conditioner according to claim 1 in which said Fabric Treatment Agent is present in an amount of from 0.25% by weight to 5% by weight.

5. A rinse conditioner according to claim 1 in which the amount of Fabric Treatment Agent to fabric softening compound is in a ratio of from 1:500 to 4:1.

6. A rinse conditioner according to claim 1 in which the amount of water insoluble oil to Fabric Treatment Agent is in a ratio of from 1:200 to 1:2.

7. A rinse conditioner according to claim 1, wherein the Fabric Treatment Agent is an insect control agent, hygiene agent or fabric anti-fading agent.

8. A process for treating laundry, the process having the following steps:

i) placing the laundry in a domestic washing machine;

ii) adding the rinse conditioner according to claim 1 to the machine and;

iii) washing or rinsing the laundry.

* * * * *